United States Patent [19]

Lantry

[11] Patent Number: 4,478,358

[45] Date of Patent: Oct. 23, 1984

[54] DISPENSING CLOSURE MECHANISM FOR RESILIENTLY SQUEEZABLE RECEPTACLES

[76] Inventor: Gerald F. Lantry, 2002 Ave. G., Council Bluffs, Iowa 51501

[21] Appl. No.: 475,749

[22] Filed: Mar. 16, 1983

Related U.S. Application Data

[63] Continuation-in-part of Ser. No. 399,268, Jul. 19, 1982, abandoned.

[51] Int. Cl.[3] ..... B65D 37/00

[52] U.S. Cl. ..... 222/213; 222/508

[58] Field of Search ..... 222/96, 212, 213, 150, 222/508

[56] References Cited

U.S. PATENT DOCUMENTS

| | | | |
|---|---|---|---|
| 523,254 | 7/1894 | Winkley | 222/213 |
| 1,288,090 | 12/1918 | McNish | 222/213 |
| 2,107,106 | 2/1938 | Crook | 222/529 X |
| 2,857,080 | 10/1958 | Elias | 222/213 |
| 2,908,423 | 10/1959 | Bross | 222/213 |
| 3,868,188 | 2/1975 | Velardi | 222/213 X |

*Primary Examiner*—F. J. Bartuska
*Attorney, Agent, or Firm*—George R. Nimmer

[57] ABSTRACT

Disclosed are closure mechanism for the open-neck of manually resiliently squeezable receptacles permitting liquid to be dispensed through the open-neck only so long as manual pressure is being exerted against a visually indicated portion of the receptacle deflectable wall. The dispensing closure mechanism generally includes: a cap secured to the open-neck and having a leadward outlet-opening; a longitudinally extending and movable spindle and preferably having a shoulder attached thereto inside the receptacle; and a yieldable seat for the spindle such as a resiliently stretchable gasket secured to the cap and constrictably surrounding the spindle. Accordingly, maintenance of manual pressure against the receptacle deflectable wall moves the spindle causing fluid dispensing such as via the gasket central-opening. Novel optional features include special shields overlying the cap, specially contoured and/or visually marked receptacle walls, various yieldable seats for the spindle, etc.

20 Claims, 16 Drawing Figures

FIG.2
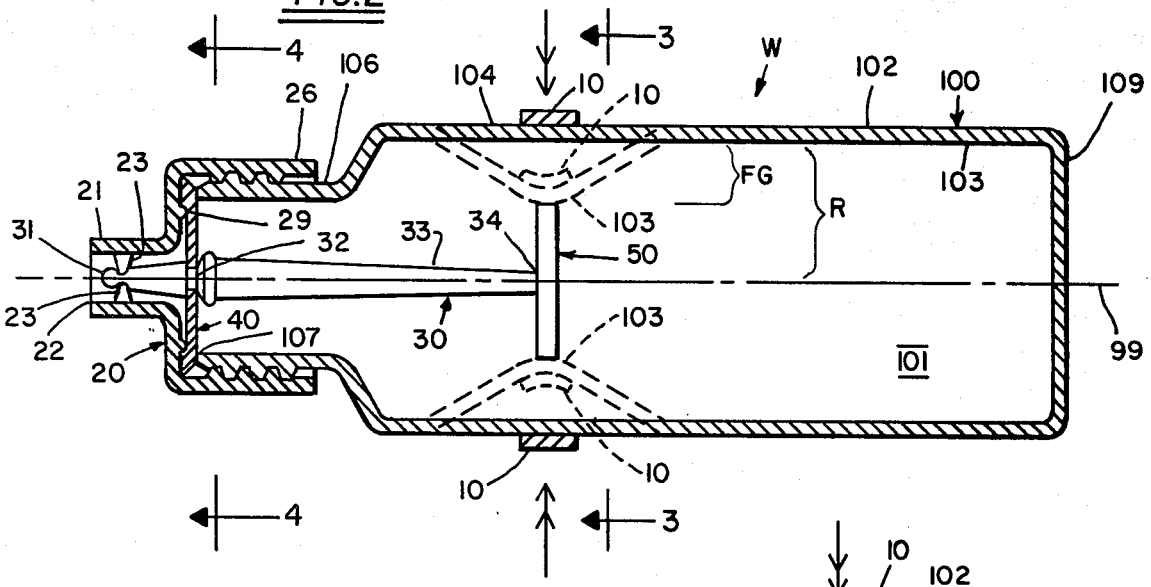
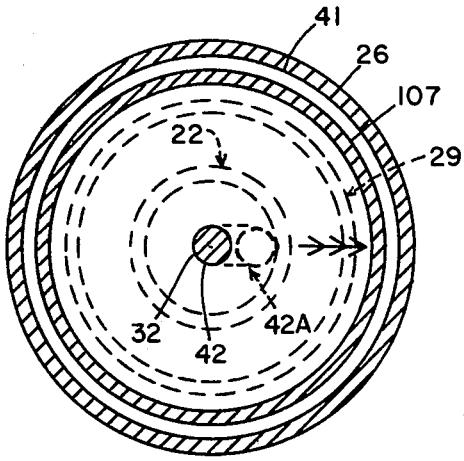
FIG.4
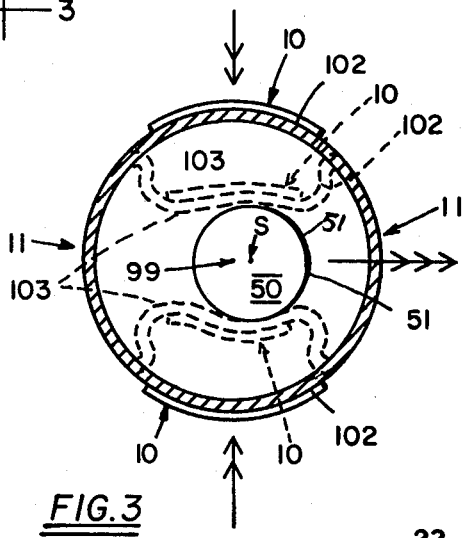
FIG.3
FIG.7
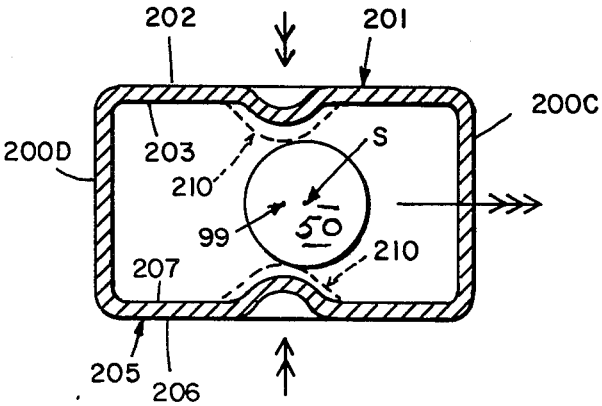
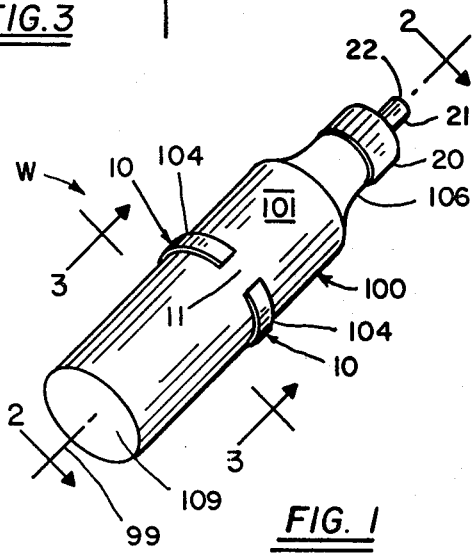
FIG. 1

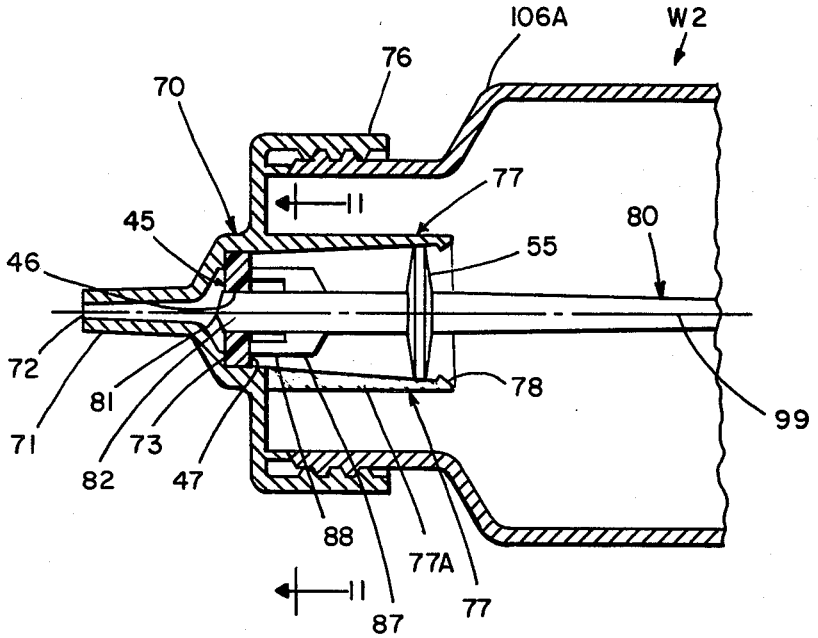
FIG. 10
FIG. 11
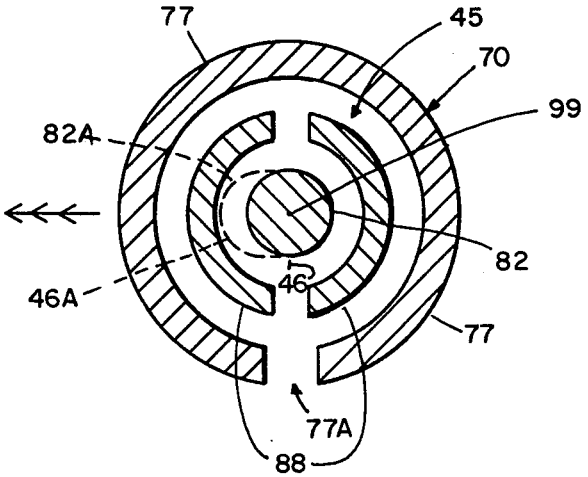
FIG. 12
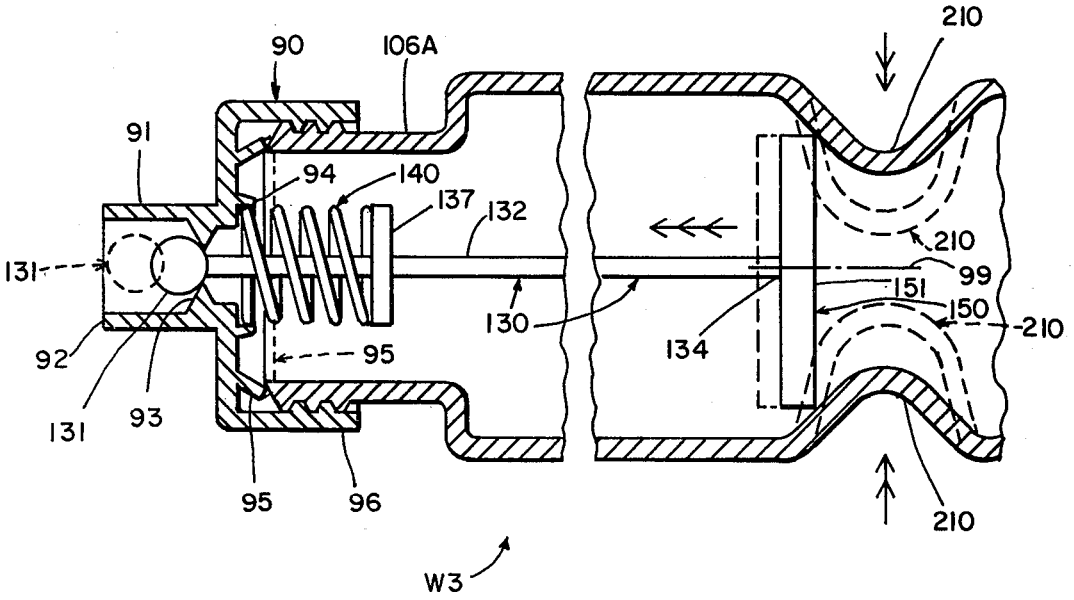

DISPENSING CLOSURE MECHANISM FOR RESILIENTLY SQUEEZABLE RECEPTACLES

This is a continuation-in-part of application Ser. No. 06/399,268, filed July 9, 1982 now abandoned.

The dispensing closure for resiliently squeezable receptacles of the present invention is generally related to the prior art teachings of U.S. Pat. Nos. 2,107,106(Crook-Feb. 1, 1938) and 2,857,080(Elias-Oct. 21, 1958). However, dispensing closures of the prior art suffer from one or more of the following disadvantages and deficiencies. Certain prior art devices are unable to automatically fully re-close upon release of the receptacle wall manual pressure whereby wasted surplusage of fluid is inadvertently dispensed. Particularly is this true when the liquid being dispensed is viscous such as liquid soaps and the like. Other prior art devices are prone to unwanted discharge of fluid if the receptacle is bumped or otherwise accidentally subjected to relatively minor jarring forces. Certain other prior art devices require cumbersome two-hands operation and/or a plurality of manual operations, which operations are exceedingly inconvenient for all would-be operators and particularly for physically handicapped persons. Some prior art devices are of exceedingly complicated and cumbersome construction whereby they are fraught with unreliability, difficulty to use, and unwanted economic expense.

It is accordingly the general objective of the present invention to provide improved dispensing closure mechanisms for resiliently squeezable receptacles and that overcome the disadvantages and deficiencies of prior art devices. Ancillary general objectives include the provision of dispensing closure devices, and for a wide range of viscosities, that will reliably dispense and automatically reclose (and from numerous attitudes of the receptacle), that will dispense liquid at an even flow rate and only while the receptacle is being manually squeezed, that requires only moderate manual pressure to operate yet that is resistant to unwanted dispensing from accidental bumping or jarring, that is amenable to one-hand operation and even by physically handicapped persons, that is relatively inexpensive and yet of reliable operation, that can be repeatedly reused on different receptacles, and wherein the receptacle might be versatilely mounted or otherwise stably supported for further ease of use.

With the above and other objects and advantages in view, which will become more apparent as this description proceeds, the dispensing closure mechanisms for resiliently squeezable receptacles generally comprise: cap means secureable to the receptacle leadward open-neck and the cap being provided with a leadward outlet-opening for fluid delivery from the squeezable receptacle; an elongate spindle extending along the receptacle longitudinal axis, the spindle leadward portion being movably associated with the cap means; a yieldable seat for the spindle, such as a resiliently stretchable gasket tightly surrounding the spindle, a helical spring surrounding the spindle, etc.; preferably, shoulder means attached to the spindle remotely trailwardly of the yieldable seat and having a finite-gap away from a visually indicated longitudinal position of the receptacle deflectable wall means whereby exertion of manual pressure to indicated locations of the wall means moves the spindle causing ultimate fluid delivery past the yieldable seat and thence through the cap means outlet-opening; and together with other optionally employable novel features including, inter alia, special shields overlying the cap means, uniquely contoured receptacle walls, various yieldable seats and spindles, etc.

In the drawing, wherein like characters refer to like parts in the several views, and in which:

FIG. 1 is a perspective view of a first embodiment "W" of the dispensing closure mechanism in combination with a generally circular receptacle;

FIG. 2 is a longitudinally extending sectional elevational view taken along line 2—2 of FIG. 1;

FIG. 3 is a sectional elevational view taken along lines 3—3 of FIGS. 1 and 2;

FIG. 4 is a sectional elevational view taken along line 4—4 of FIG. 2;

FIG. 7 is a sectional elevational view (similar to FIG. 3) taken along lines 7—7 of FIGS. 5 and 6;

FIG. 10 is a sectional elevational view (similar to FIG. 2) of a second embodiment "W2" of the dispensing closure mechanism if the present invention;

FIG. 11 is a sectional elevational view taken along line 11—11 of FIG. 10;

FIG. 12 is a sectional elevational view (similar to FIGS. 2 and 10) of a third embodiment "W3" of the dispensing closure mechanism of the present invention;

Figure 5:
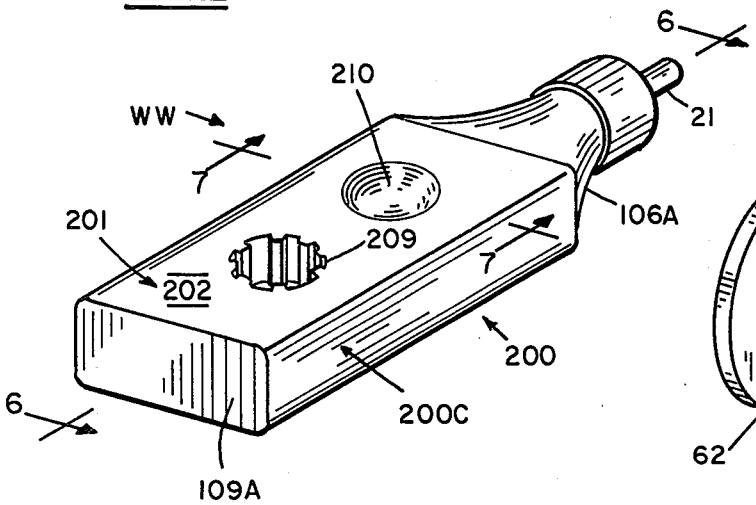
FIG. 5 is a perspective view of the first embodiment of the dispensing closure mechanism in combination with a generally rectangular receptacle and having other optional features.

Turning initially to drawing FIGS. 1–4 which depict first embodiment "W" of the dispensing closure mechanism of the present invention wherein the resiliently squeezable receptacle 100 has a generally cylindrical and longitudinally extending deflectable wall means 101 circularly surrounding central-axis 99. Receptacle 100 has as its two longitudinally separated terminii a trailward closed bottomwall 109 and a leadward open-neck 106 having annular terminus 107 that circularly surrounds said axis 99. Cylindrical wall means 101 has an outside surface 102 and an inside surface 103, the latter being spaced a radial distance "R" from axis 99. Intermediate the receptacle terminii 106 and 109, the deflectable wall means 101 has a visually indicated site 104 to indicate where manual pressure is to be correctly exerted for causing ultimate fluid delivery through a cap means outlet-opening (e.g. 22). For cylindrical receptacle 100, the visual indicator means takes the form of two equal-length strips (and having two equal-length separations 11) adhered at wall outside surface 102 whereby strips 10 are spaced a constant distance from axis 99.

Cap means 20 is provided with a said leadward outlet-opening of snout-like form 21 having annular leadward terminus 22 that circularly surrounds axis 99. Cap means 20 has a trailward boss 29 circularly surrounding central-axis 99 and co-axial spindle 30. The cap means is removably secured to receptacle open-neck 106, such as by cap means skirt 26 threadedly engaged with open-neck 106.

Elongate spindle 30 lies along receptacle axis 99, and the longitudinal length thereof includes:

i. a lead-end providing the spindle terminus nearest the cap means outlet-opening 22, ii. a leadward-length (e.g. 32) surrounded by the receptacle open-neck 106, and iii. a trailward-length 33 within receptacle 100 and terminating at spindle trail-end 34. In embodiment "W", spindle 30 has a fixed longitudinal position along axis 99, and nearer its lead-end 31 than to trail-end is pivotably attached to cap means 20. In the latter vein, spindle 30 at its enlarged lead-end 31 is pivotably snap-fit into four convegent internal ribs 23 of snout 21.

There is a centrally-open (42) gasket 40 having a periphery 41 surrounding circularly axis 99 and said central-opening 42. Gasket 40 is normally-directionally resiliently stretchable and provides, inter alia, a yieldable seat for the spindle such as having its opening 42 constrictably surrounding spindle annular notch 32 and being secured to the cap means trailwardly of outlet-opening 22. In the latter vein, gasket 40 is pinchably secured between tapered end 107 of open-neck 106 and trailward boss 29 of cap means 20. Thus, as will be indicated in FIG. 4, normal-directional movement for spindle 30 streches gasket central-opening 42 to an enlarged oval condition to permit fluid flow therethrough for ultimate delivery through the cap means outlet-opening 22.

There are shoulder means (e.g. 50) attached to the spindle remotely trailwardly of the yieldable seat therefor (e.g. 40), said shoulder means being of co-longitudinal position with the visual indicator means and being normally-directionally offset from the spindle with a finite-gap "FG" existing between the shoulder means periphery 51 and the receptacle wall means. Finite-gap "FG" provides at least about one-tenth the wall distance (e.g. "R") from receptacle centralaxis 99 whereby maintenance of normally directed manual pressure (indicated by double-headed arrows) to the visually indicated (10) wall means moves said shouldered spindle (indicated by triple-headed arrows) to overcome the yieldable seat (e.g. 40) permitting fluid flow through the cap means outlet-opening. Also, by virtue of said finite-gap "FG", inadvertent jarring forces to the receptacle walls will not cause unintended liquid dispensing. Herein, the shoulder means takes the form of a rim 50 circularly (51) surrounding the rim geometric center "S" that is in lateral normal-direction offset from axis 99 and spindle 30. Thus, as indicated in phantom lines in FIG. 3, transverse normal-directional manual squeezing to the correctly visually indicated (10) receptacle wall means 101 cams against the rim type shoulder 50 causing it and the attached spindle to move directionally transversely. Accordingly, as is indicated in FIG. 4, this laterally stretches the gasket circular central-opening 42 to an oval condition 42A permitting fluid passage therethrough and ultimately through the cap means outlet-opening 22.

Figure 6A:
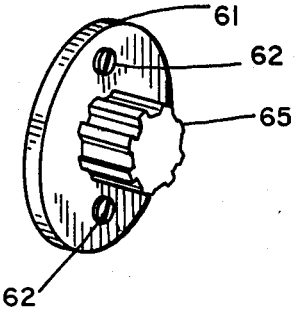
FIG. 6A is a perspective view of an exteriorally mountable carrier means environment for the structure of FIGS. 5–7.
Figure 6:
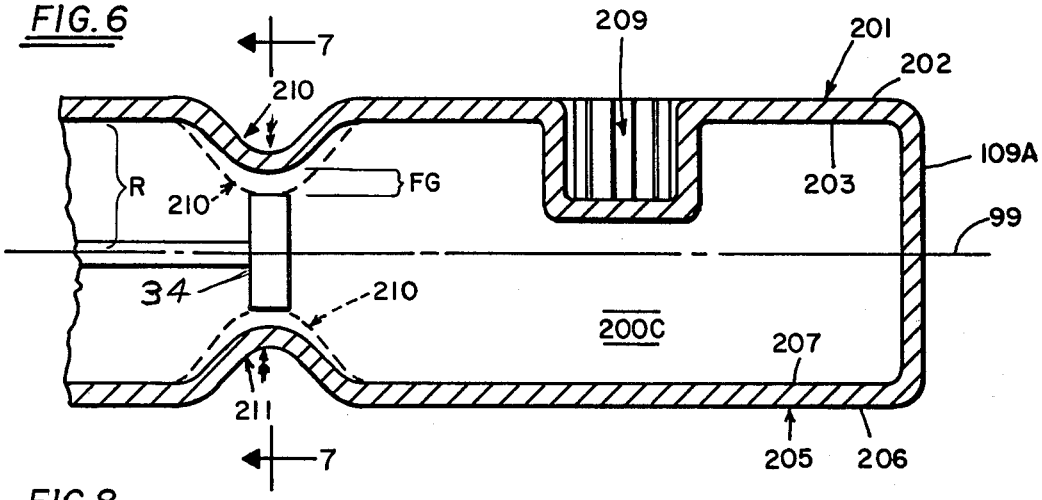
FIG. 6 is a longitudinally extending sectional elevational view (similar to FIG. 2) taken along line 6—6 of FIG. 5.

Embodiment "WW" of FIGS. 5-7 differs from embodiment "W" of FIGS. 1-4 only in that resiliently squeezable receptacle 200 is substituted for receptacle 100. Resiliently squeezable receptacle 200 even has an annularly circular open-neck 106A which terminates at tapered end 107. However, the deflectable wall means for receptacle 200 includes generally parallel opposed and longitudinally extending sidewalls 201 and 205, and further includes generally parallel opposed and longitudinally extending endwalls 200C and 200D, all terminating at generally rectangular bottomwall 109A. For the respective sidewalls 201 and 205, there are outside surfaces (202, 206) and inside surfaces (203, 207). For the visual indicator means, at least one of the receptacle opposed sidewalls (having transverse spacing 2R) is provided with a transversely directionally extending indentation; for embodiment "WW", both sidewalls (201, 205) are provided with colongitudinal indented dimples (210) as visual indicator means. There is a finite-gap "FG" between shoulder 50 and each dimple indentation 201 at surfaces 203 and 207. Thus, analagously as in FIG. 3, and as similarly indicated in FIG. 6 phantom lines, transverse normal-directional manual squeezing to the correctly visually indicated (210) receptacle wall means cams against the rim type shoulder 50 causing it and the attached spindle 30 to provide the gasket stretched condition shown in FIG. 4 as 42A.

If the receptacle wall means is provided with one or more bores e.g. 209, the receptacle might be removably engaged with some kind of exteriorally mounted carrier means e.g. 60. Such receptacle removable engagement might be at selectable attitude and at operational condition for the dispensing closure mechanism. Exteriorally mountable carrier means might take the representative form of FIG. 6A comprising a plate 61 mountable by screws (62) to some environment (such as a shower stall, etc) and having a peg 65 adapted to be removably engaged with the receptacle wall bore e.g. 209. Use of a splined bore and mateable peg facilitates the receptacle to be mounted at selectable attitudes.

Figure 8:
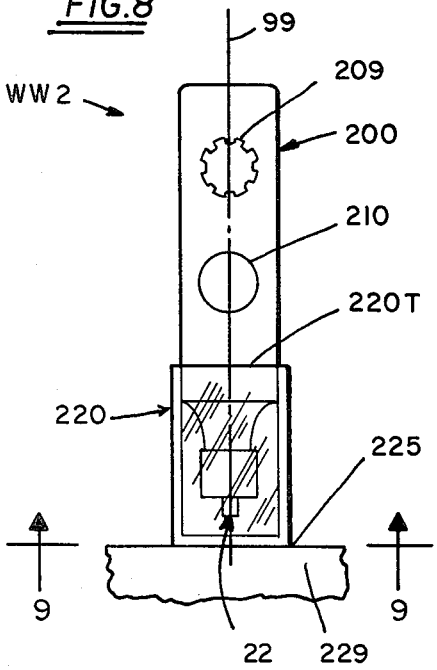
FIG. 8 is a side elevational view of the FIGS. 5–7 structure having a novel shield in removable combination therewith.
Figure 9:
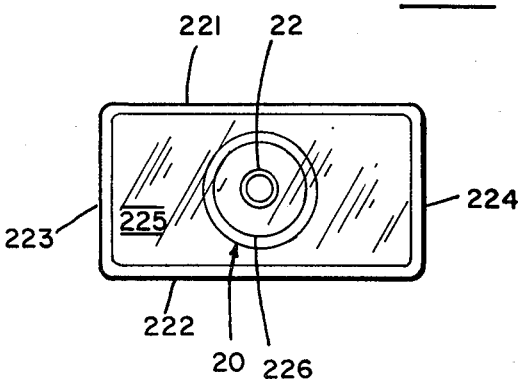
FIG. 9 is a sectional plan view taken along line 9—9 of FIG. 8.

Embodiment "WW2" of FIGS. 8 and 9 differs from embodiment "WW" of FIGS. 5-7 in that a shield 220 is removably associated with receptacle 200 over the cap means whereby embodiment "WW2" might be uprightly supported upon a horizontal tabletop surface 229 as shown in FIG. 8. Shield 220 comprises an apron formed by four interconnected longitudinally extending transparent panels 221-224 surrounding and frictionally engaged with receptacle 200 in a condition where the apron trailward terminus (220T) is located leadwardly of (and so as to not interfere with) the manually pressable visual indicator means 210. Shield 220 also includes a lead-panel 225 having a uniplanar leadface perpendicularly intersecting axis 99 and having an access-opening 226 in longitudinal communication with cap outlet-opening 22.

Embodiment "W2" of FIGS. 10 and 11 represents a dispensing closure mechanism having a spindle carried shoulder means 50 and a visually indicated squeezed receptacle (100 or 200) identical to that of embodiments "W" and "WW". Though embodiment "W2" also uses the trailward-length 33 and the trail-end 34 of the spindle and the laterally offset shoulder 50, dispensing closure mechanism "W2" differs from that shown in FIGS. 1-7 in the following respects. Cap means 70, akin to cap means 20, has a leadward snout 71 having an annular outlet-opening terminus 72 and an outer-skirt 76 removably threadably secured to receptacle open-neck (106, 106A). Cap means 70 has a circular inner-skirt 77 surrounded by the receptacle open-neck; as evidenced by lengthy slot 77A, inner-skirt 77 incompletely surrounds axis 99 to permit fluid flow toward central-opening 46 of resiliently stretchable gasket 45 which abuts inner-skirt leadward terminus 73. Spindle 80 has its lead-end 81 located trailwardly of outlet-opening 72 and has its leadward-length at 82 constrictably surrounded by gasket central opening 46. For the purpose of facilitating installation of gasket 45 to its situs 73, inner-skirt 77 circularly surrounds axis 99 at 73 and 45, but thence diverges toward terminus 78. Trailwardly of gasket 45, spindle 80 carries a flange 55 snap-fit into inwardly flared terminus 78 to provide a pivotal association between cap means 70 and spindle 80. Between gasket 45 and flange 55, spindle 80 carries a collar 87 having two separate and leadwardly extending webs 88 contacting gasket trailward side 47 and tending to urge gasket 45 toward its intended circular seat 73. Thus, analagously as in FIG. 4, normal-directional manual squeezing applied to the visually indicated (10, 210) deflectable wall means causes surrounded spindle part 82 to force gasket central-opening 46 to enlarge to a fluid-pervious oval condition as indicated at 46A and 82A phantom lines in FIG. 11.

For each of the herebefore described embodiments of the dispensing closure mechanism, spindle movement is pivotal only (i.e. not longitudinally along axis 99) and the spindle's yieldable seat is in the form of a resiliently stretchable gasket (e.g. 40, 45). However, embodiment "W3" of FIG. 12 differs from the previously described embodiments in that the yieldable seat takes the form of a helical spring (140) surrounding axis 99 and that receptacle manual squeezing causes the longitudinal spindle (130) to move longitudinally along axis 99 rather than to merely pivotably move. For embodiment "W3", cap means 90 has its skirt 96 threadedly engaged to receptacle open-neck similar as for cap means 20 and 70. Cap means 90 has snout 91 having annular terminus 92 and inwardly extending annular lip surrounding axis 99. The trailward side of cap 90 includes an annular boss 94 surrounding axis 99 to receive the leadward side of helical spring 140 and a diametrically larger deflectable-skirt 95 so as to deflectably seal against receptacle open-neck 106, 106A. Spindle 130 lies along axis 99 and has:

an enlarged lead-end 131 seated at lip 93;

a leadward-length 132 carrying a surrounding collar 137 which maintains spring 140 between collar 137 and boss 94; and trail-end 134 carrying shoulder 150.

Shoulder 150 differs from shoulder 50 in that it need not be eccentrically mounted to the spindle and in that it has a slightly convex trailward side 151 which is located slightly leadwardly of the visual indicator means e.g. 210. Thus, as indicated in FIG. 12 phantom line, manual pressure exerted against the visual indicator means causes shoulder 150 and attached spindle 130 to move longitudinally along axis 99 thereby compressing spring 140 and thus moving lead-end 131 leadwardly away from lip 93. Accordingly, fluid flow is permitted past lip 93 and thence through the cap outlet-opening 92.

Figure 13:
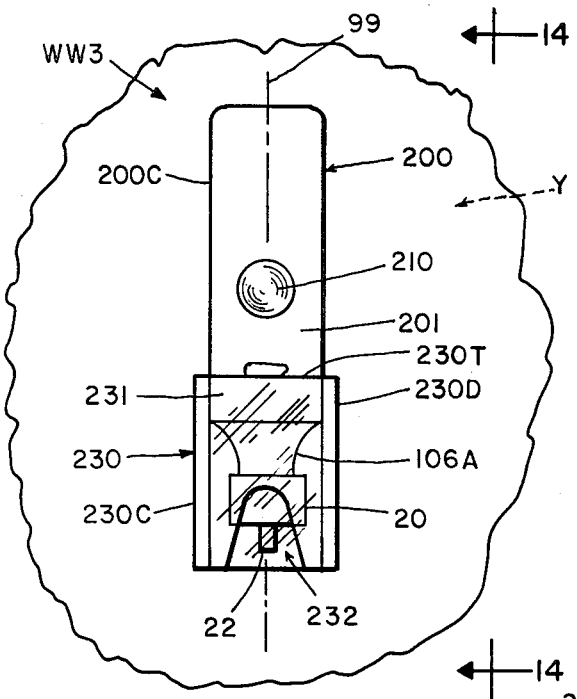
FIG. 13 is a frontal side elevational view (similar to FIG. 8) of the FIGS. 5–7 dispensing structure having a wall-mountable novel shield in removable combination therewith.
Figure 14:
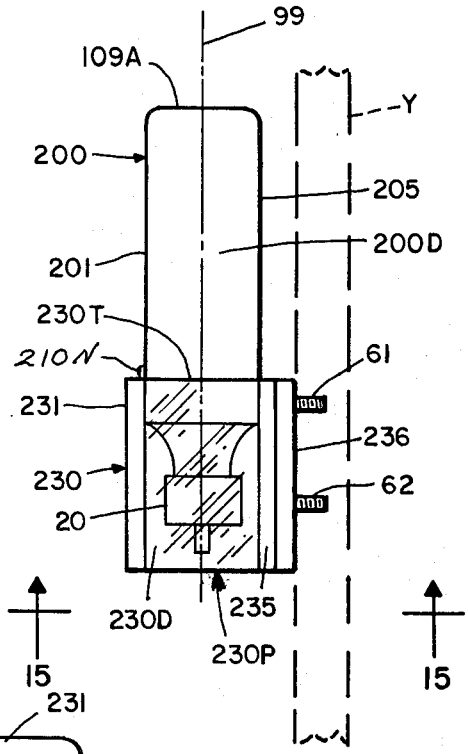
FIG. 14 is a side elevational view taken along line 14—14 of FIG. 13.
Figure 15:
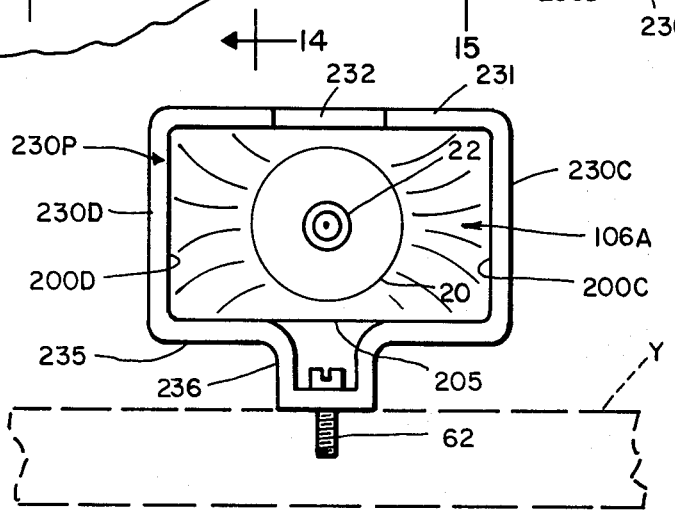
FIG. 15 is a bottom plan view (similar to FIG. 9) of the FIGS. 13 and 14 shielded structure and taken along line 15—15 of FIG. 14.

Turning now to FIGS. 13–15 which depict shielded embodiment "WW3" comprising a selected receptacle embodiment e.g. "WW" in removable combination with shield 230. Shield 230 of embodiment "WW3" differs from shield 220 of embodiment "WW2" (FIGS. 8–9) primarily in that shield 220 is intended to uprightly support embodiment "WW" upon a tabletop surface (e.g. 229) whereas shield 230 is intended to uprightly support embodiments "W", "WW", etc., from a vertical room-wall (e.g. "Y"). Analagous to shield 220, shield 230 comprises an apron formed by a plurality of connected and vertically longitudinally extending transparent panels, such as: planar front-panel 231, planar left-panel 230C and right-panel 230D, and rear-panel 235 having rearwardly extending upright spacer part 236. And analagous to terminus 220T for shield 220, the apron for shield 230 has a trailward upper terminus 230T located leadwardly of the visual indicator means e.g. 10, 210. The inside surfaces of interconnected panels 231, 230C. 230D, and 235 are collectively frictionally engageable with receptacle walls 201, 200C, 200D, and 205, thereby maintaining the elevation of receptacle outlet-end 22 slightly above shield horizontal bottom-end 230P. In this regard, one of the receptacle walls might be provided with a nib (e.g. 210N) to ensure the relative elevation for outlet-end 22. Front-panel 231 is desireably provided with a lower-central cutout portion 232 thereby physically exposing snout terminus 22 and part of cap 20 to a frontal observer. Screws 61 and 62, passing horizontally through rear-panel spacer part 236, mount the shield 230 to room-wall "Y". Use of the room-wall mounted shield 230, might be summarized as follows. The inverted receptacle e.g. "W", "WW", etc., is maintained in elevation by shield 230 in condition wherein the snout terminus 22 is liberally forwardly spaced away from room-wall "Y" and is clearly viewable and physically accessible to a frontally positioned user of the dispenser. The user then presses the digit of one hand against the visual indicator e.g. 10, 210, while also holding the other hand at cutaway 232 and bottom-end 230P to receive the dispensed fluid emerging from outlet-end 22.

From the foregoing, the construction and operation of the dispensing closure concepts for resiliently squeezable receptacles will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

What is claimed is as follows:

1. In combination with an elongate receptacle for fluid that comprises resiliently deflectable wall means surrounding a longitudinally extending central-axis and comprises as its two longitudinally separated terminii a leadward open-neck surrounding and a trailward closed bottomwall intersecting said central-axis, a dispensing closure mechanism for the receptacle open-neck and comprising:

A. cap means provided with a leadward outlet-opening for fluid delivery and surrounding said central-axis and being secured to the receptacle open-neck;

B. an elongate spindle extending and having a fixed longitudinal position along said central-axis, said spindle lengthincluding:

i. a lead-end providing the spindle nearest proximity to the cap means outlet-opening, ii. a leadward-length located trailwardly of said lead-end and being surrounded by the receptacle open-neck, and iii. a trailward-length located trailwardly of said leadward-length and terminating at a spindle trail-end located leadwardly remote of the receptacle bottomwall, said spindle nearer to the lead-end than to the trail-end being pivotably secured to the cap means;

C. a centrally-open gasket providing a yieldable seat for the spindle and being secured to the cap means trailwardly of the outlet-opening, said gasket in both transverse and lateral normal-directions intersecting the central-axis and being resiliently stretchable, and said gasket constrictably surrounding the spindle nearer to the lead-end than to the trail-end thereof;

D. said receptacle deflectable wall means between said receptacle terminii being provided with visual indicator means to indicate where manual pressure is to be correctly exerted for causing ultimate fluid delivery through the cap means outlet-opening; and E. shoulder means attached to the spindle remotely trailwardly of the gasket, said shoulder means being in longitudinal alignment with said visual indicator means and being normally-directionally offset from the spindle whereby a finite-gap exists between said shoulder means and said wall means in alignment with the visual indicator means, said finite-gap providing at least about one-tenth the distance between the receptacle central-axis and deflectable wall means whereby maintenance of normally directed manual pressure exerted against the visually indicated wall means contacts said shoulder means causing it and the attached spindle to move normally-directionally and resiliently stretch the gasket central-opening to permit fluid delivery therethrough and thence untimately through the gap means outlet-opening.

2. The combination of claim 1 wherein the deflectable wall means includes generally parallel opposed sidewalls at least one of which is provided with a transversely directionally extending indentation to provide an intended style visual indicator means; and wherein the shoulder means takes the form of a rim generally circularly surrounding a trailward-length of the spindle and spaced said finite-gap from the indented sidewall style visual indicator means.

3. The combination of claim 2 wherein the rim geometric center is laterally directionally offset from the receptacle central-axis; and wherein both receptacle opposed sidewalls are provided with transversely inwardly extending indentations that are in longitudinal alignment with each other and with said rim, whereby maintenance of said transversely directed pressure to the opposed sidewalls indentations cams against the rim causing it and the attached spindle to move directionally laterally and laterally resiliently stretch the gasket central-opening.

4. The combination of claim 3 wherein the cap means comprises an outer-skirt removably surrounding the receptacle open-neck and an inner-shirt surrounded by the receptacle open-neck; wherein the gasket is securely surrounded by the inner-skirt; wherein the spindle leadward-length trailwardly of the gasket is provided with a flange that is pivotably associated within a fixed longitudinal position of the inner-skirt; and wherein the inner-skirt incompletely surrounds the spindle so as to permit fluid flow leadwardly past the flange toward the gasket resiliently stretchable central-opening.

5. The combination of claim 4 wherein the spindle leadward-length leadwardly of the pivotably associated flange is provided with separated webs bearing against the gasket to retain the gasket in the leadward direction.

6. The combination of claim 5 wherein at least one of said receptacle sidewalls is provided with a transversely extending bore adapted to be removably engaged at selectable attitude with an exteriorally mountable carrier means.

7. The combination of claim 3 wherein the cap means comprises an outer-skirt removably surrounding the receptacle open-neck; wherein the cap means includes a leadwardly terminal snout defining said outlet-opening; and wherein the spindle leadward-length is pivotably associated within a fixed longitudinal position of a radially ribbed portion of said snout.

8. The combination of claim 7 wherein the cap means includes a trailward boss surrounding the spindle; wherein the gasket leadwardly abuts said boss and is provided with a trailward groove surrounding the gasket central-opening; and wherein the receptacle open-neck is sharply tapered and presses against the gasket trailward groove.

9. The combination of claim 8 wherein at least one of said receptacle sidewalls is provided with a transversely extending bore adapted to be removably engaged at a selectable attitude with an exteriorally mountable carrier means for said combination.

10. The combination of claim 1 wherein there is a shield removably associated with the receptacle and comprising a lead-panel positioned leadwardly of the cap means outlet-opening, said lead-panel being provided with an access-opening means in longitudinal alignment with said outlet-opening, said shield removable association with the receptacle being provided by an apron terminating trailwardly from the lead-panel whereby the entire shield is located leadwardly of the visual indicator means.

11. The combination of claim 10 wherein the shield apron is non-opaque and completely surrounds the cap means; and wherein the lead-panel has a uniplanar lead-face perpendicularly intersecting the receptacle central-axis.

12. The combination of claim 1 wherein there is a shield comprising an apron removably frictionally engaged about an inverted said receptacle between the visual indicator means and the cap means, said apron including a front-panel having a cutout portion in horizontal registry with the cap means and outlet-opening, said apron having an annular bottom-end in vertical registry with the outlet-opening, and said apron including a rearwardly extending upright spacer part mountable to a room-wall whereby the outlet-opening might be spaced liberally away from a said room-wall.

13. In combination with an elongate receptacle for fluid and that includes resiliently deflectable wall means surrounding a longitudinally extending central-axis and includes as its two longitudinal separated terminii a leadward open-neck surrounding and a trailward closed bottomwall intersecting said central-axis, a removably secured dispensing closure mechanism for the receptacle open-neck and comprising:

A. cap means provided with a leadward outlet-opening for fluid delivery and surrounding said central-axis and being removably secured to the receptacle open-neck;

B. an elongate spindle extending along said central-axis, said spindle length including:

i. a lead-end located trailwardly of and providing the spindle nearest proximity to the cap means outlet-opening, ii. a leadward-length located trailwardly of said lead-end and being surrounded by the receptacle open-neck, and iii. a trailward-length located trailwardly of said leadward-length and terminating at the spindle trail-end;

C. a yieldable seat for the spindle and located in surrounding relationship to the spindle nearer to the lead-end than to the trail-end thereof;

D. said receptacle deflectable wall means between said receptacle terminii being provided with visual indicator means to indicate where manual pressure is to be correctly exerted for causing ultimate fluid delivery through the outlet-opening; and E. a rim type shoulder surrounding and attached to the spindle remotely trailwardly of said yieldable seat, said shoulder being co-longitudinal with said visual indicator means and being normally-directionally offset from the spindle whereby a finite-gap exists between said shoulder and said visually indicated wall means, whereby maintenance of manual pressure exerted against the visually indicated wall means contacts the rim type shoulder causing it and the spindle to move so as to thereby overcome the yieldable seat to permit fluid flow past the spindle leadward-length and thence ultimately through the cap means outlet-opening.

14. The combination of claim 13 wherein said deflectable wall means includes generally parallel opposed sidewalls, at least one of which is provided with a transversely extending inward indentation to provide an indented style visual indicator means.

15. The combination of claim 14 wherein the yieldable seat comprises a centrally-open gasket secured to the cap means trailwardly of the cap means outlet-opening and in both transverse and lateral normal-directions intersecting the central-axis, the gasket in normal-directions being resiliently stretchable and constrictably surrounding the spindle, whereby maintenance of inward manual pressure against said indented visual indicator means resiliently stretches the gasket central-opening to permit fluid flow therethrough and thence through the cap means outlet-opening.

16. The combination of claim 15 wherein there is a shield comprising an apron removably frictionally engaged with an inverted said receptacle between the visual indicator means and the cap means; and wherein at least one of said receptacle sidewalls is provided with an inwardly extending splined bore adapted to be removably engaged at selectable attitude with an exteriorally mountable carrier means.

17. In combination with an elongate receptacle for fluid that comprises a resiliently deflectable wall means surrounding a longitudinally extending central-axis and comprises as its two longitudinally separated terminii a leadward open-neck surrounding and a trailward closed bottomwall intersecting said central-axis, a removably secured dispensing closure mechanism for the receptacle and comprising:

A. cap means provided with a leadward outlet-opening for fluid delivery and surrounding said central-axis and being secured to the receptacle open-neck;

B. an elongate spindle extending and having a fixed longitudinal position along said central-axis, said spindle length including:

i. a lead-end located trailwardly of and providing the spindle nearest proximity to the cap means outlet-opening, ii. a leadward-length located trailwardly of said lead-end and being surrounded by the receptacle open-neck, and iii. a trailward-length located trailwardly of said leadward-length and terminating at a spindle trail-end located nearer to the outlet-opening than to the bottomwall, said spindle nearer to the lead-end than to the trail-end being pivotably secured to the cap means;

C. a centrally-open gasket secured to the cap means trailwardly of the outlet-opening thereof and in both transverse and lateral normal-directions intersecting said central-axis, said gasket in the normal-directions being resiliently stretchable, said gasket providing a yieldable seat for the spindle and constrictably surrounding the spindle nearer to the lead-end than to the trail-end thereof; and D. said receptacle wall means between said receptacle terminii and in substantial longitudinal alignment with the spindle trail-end being provided with visual indicator means to indicate where manual pressure is to be correctly exerted toward the spindle trailward-length and for causing spindle movement normal to said central-axis whereby maintenance of normally directed manual pressure exerted against the visually indicated wall means causes said spindle to move normally-directionally and resiliently stretch the gasket central-opening to permit fluid delivery therethrough and thence ultimately through the cap means outlet-opening.

18. The combination of claim 17 wherein there is a shield comprising an apron removably engaged with a leadward portion of the receptacle at the open-neck thereof and for supporting the receptacle-equipped closure mechanism in an inverted condition.

19. The combination of claim 18 wherein said apron includes a front-panel having a cutout portion in horizontal registry with the cap means and outlet-opening, said apron having an annular bottom-end in vertical registry with the outlet-opening, and said apron including a rearwardly extending upright spacer part mountable to a room-wall whereby the outlet-opening might be spaced liberally away from a said room-wall.

20. The combination of claim 19 wherein the deflectable wall means includes generally parallel opposed sidewalls at least one of which is provided with a transversely directionally extending indentation to provide an indented style visual indicator means; and wherein there is a rim like shoulder means generally circularly surrounding and attached to the spindle trailward-length, and said shoulder means being spaced a finite-gap from the indented sidewall visual indicator means.

* * * * *